US007138990B2

(12) United States Patent
Kim

(10) Patent No.: US 7,138,990 B2
(45) Date of Patent: Nov. 21, 2006

(54) GATE PULSE MODULATOR

(75) Inventor: Eun Ji Kim, Gyeongsangbuk-Do (KR)

(73) Assignee: KEC Corporation (KR)

( * ) Notice: Subject to any disclaimer, the term of this patent is extended or adjusted under 35 U.S.C. 154(b) by 0 days.

(21) Appl. No.: 10/950,254

(22) Filed: Sep. 27, 2004

(65) Prior Publication Data

US 2005/0078102 A1 Apr. 14, 2005

(30) Foreign Application Priority Data

Oct. 9, 2003 (KR) ..... 10-2003-0070381

(51) Int. Cl.
*G09G 3/36* (2006.01)
*G09G 5/00* (2006.01)

(52) U.S. Cl. ..... 345/204; 345/92; 345/94

(58) Field of Classification Search ..... 345/92, 345/94, 204, 211
See application file for complete search history.

(56) References Cited

U.S. PATENT DOCUMENTS 6,028,578 A * 2/2000 Ota et al. ..... 345/94
6,191,768 B1 * 2/2001 Imamura ..... 345/98
2002/0036626 A1 * 3/2002 Tsutsui ..... 345/204

* cited by examiner

*Primary Examiner*—Robart J. Pascal
*Assistant Examiner*—James Goodley
(74) *Attorney, Agent, or Firm*—St. Onge Steward Johnston & Reens LLC

(57) ABSTRACT

Disclosed is a gate pulse modulator. The inventive gate pulse modulator includes an input control unit receiving inputs from a gate high signal terminal, a clock signal terminal and a control signal terminal. In addition, the inventive gate pulse modulator includes an output control unit connected to the gate high signal terminal, the control signal terminal and an external driving signal terminal, wherein the output control unit supplies a base voltage to a gate driving unit when the control signal is low, and in the state where the control signal is high, the output control unit supplies a gate high voltage to the gate driving unit if the clock signal is high and supplies a driving voltage to the gate driving unit if the clock signal is low. In addition, the invention further comprises a time delay unit connected to a stage prior to the input control unit, so that the gate high voltage delayed for a predetermined length of time is supplied to the gate driving unit. Furthermore, a time constant adjusting resistor and a time constant adjusting capacitor are additionally connected so that the gate high voltage decreases not in a stepped pattern but in an exponential pattern.

19 Claims, 4 Drawing Sheets

GATE PULSE MODULATOR

This application claims priority of pending Korean Patent Application No. 2003-70381 filed on Oct. 9, 2003.

FIELD OF THE INVENTION

The present invention relates to a gate pulse modulator, and in particular to a gate pulse modulator which can prevent occurrence of flicker phenomenon on a liquid crystal display panel and latch-up phenomenon in a gate driving unit of a liquid crystal display device, can minimize power consumption and resistance error, and apply an output voltage having time delay to the gate driving unit, thereby preventing erroneous operation of the liquid crystal display device.

DESCRIPTION OF THE RELATED ART

In general, a liquid crystal display device, such as a TFT-LCD (Thin Film Transistor-Liquid Crystal Display), includes a bottom glass substrate formed with Thin Film Transistors (TFT's), a top glass substrate formed with a color filter, and liquid crystal interposed between the substrates. Here, the TFT's serve to transfer and control electric signals and the liquid crystal controls transmission of light by changing its molecular structure depending on an applied voltage. The light controlled in such a manner appears with desired color and picture while passing through the color filter.

Meanwhile, a gate driving unit and a data driving unit are required for driving such a liquid crystal display device. The gate driving unit sequentially supplies gate high voltage VGH so as to sequentially turn-on the TFT's. In addition, the data driving unit supplies a predetermined level of data voltage to the TFT's when the TFT's are turned on. The TFT's control the angle of liquid crystal molecules on the basis of the data voltage supplied from the data driving unit, as a result of which desired pictures appear on the liquid crystal display panel.

Referring to FIG. 1, there is shown a circuit diagram of a conventional gate pulse modulator.

As shown in FIG. 1, the conventional gate pulse modulator inputted with a predetermined level of voltage receives inputs from a gate high signal terminal 1, a control signal terminal 2, a clock signal terminal 3, a driving signal terminal 4 and a base voltage source GND, and supplies a predetermined level of voltage to an output terminal Vout as shown in FIG. 2. The gate high voltage VGH is set between 18V and 28V. The driving voltage VDD is set between 6.5V and 10V.

Such a conventional gate pulse modulator includes: a first transistor Q1 and a third resistor R3 interconnected between the clock signal terminal 3 and the base voltage source GND; a first resister R1 and a second resistor R2 interconnected between the first transistor Q1 and the gate high signal terminal 1; a sixth resistor R6 and a fifth transistor Q5 interconnected between the clock signal terminal 3 and the base voltage source GND; a fourth resistor R4, a fifth resistor R5 and a second transistor Q2 interconnected between the gate high signal terminal 1 and the base voltage source GND; a ninth resistor R9, an eighth resistor R8, a fourth transistor Q4 and a third transistor Q3 provided between the fifth transistor Q5 and the gate high signal terminal 1; an output resistor R0 and a sixth transistor R6 provided between the output voltage Vout and the driving signal terminal 4; and a seventh resistor R7 provided between the sixth transistor Q6 and the first resistor R1. Here, the second, third and fourth transistors Q2, Q3, Q4 are of PNP type and the remaining first, fifth and sixth transistors Q1, Q5, Q6 are of NPN type.

Meanwhile, a gate driving unit 6 is connected to the output terminal Vout, and a liquid crystal display panel 7 is connected to the gate driving unit 6. A data driving unit connected to the liquid crystal display panel 7 is not shown in the drawings.

In such a conventional gate pulse modulator, a control signal CS is supplied to the base terminal of the second transistor Q2. In addition, a clock signal CLK is supplied to the base terminals of the first transistor Q1 and the fifth transistor Q5. The driving voltage VDD is supplied to the emitter terminal of the sixth transistor Q6. The gate high voltage VGH is supplied to the collector terminal of the first transistor Q1, the base terminal of the sixth transistor Q6, and the emitter terminal of the third transistor Q3.

The operating procedure of the above-mentioned conventional gate pulse modulator is now described with reference to FIG. 2.

At first, if the control signal CS of low is inputted, the driving voltage VDD is outputted to the output terminal Vout. That is, the control signal CS of low is supplied to the base of the second transistor Q2. Then, the second transistor Q2 remains turned-off. In addition, if the second transistor Q2 remains turned-off, the gate high voltage VGH is applied to the fourth resistor R4, as a result of which the third transistor Q3 of PNP type is also turned off. In other words, the voltage applied to the fourth resistor R4 (the base terminal of the third transistor Q3) and the voltage applied to the emitter terminal of the third transistor Q3 become equal to each other, as a result of which the third transistor Q3 is turned off. Further, if the third transistor Q3 is turned off, no voltage is applied to the eighth resistor R8 and the ninth resistor R9, as a result of which the fourth transistor Q4 is also turned off. Like this, if the fourth transistor Q4 is turned off, the gate high voltage VGH cannot be supplied to the output terminal Vout. In other words, when the control signal CS of low is inputted, the gate high voltage VGH cannot be supplied to the output voltage Vout.

Meanwhile, if the clock signal CLK is in a low state, the first transistor Q1 is turned off. If the first transistor Q1 is turned off, a predetermined level of voltage is applied to the first and seventh resistors R1, R7. At this time, the sixth transistor Q6 is turned on due to the difference between the voltage applied to the seventh resistor R7 and the driving voltage VDD. If the sixth transistor Q6 is turned on, the driving voltage VDD is applied to the output resistor R0, as a result of which the driving voltage VDD is supplied to the output terminal Vout.

In addition, when the clock CLK is in a high state, the first transistor Q1 is turned on. If the first transistor Q1 is turned on, a predetermined level of voltage is applied to the first and second resistors R1, R2. At this time, the sixth transistor Q6 is turned on due to the voltage applied to the second resistor R2. If the sixth transistor Q6 is turned on, the driving voltage VDD is applied to the output resistor R0. Consequently, the driving voltage VDD is applied to the output terminal Vout. That is, with the conventional gate pulse modulator, the driving voltage VDD is always supplied to the output terminal Vout, i.e., to the gate driving unit 6 when the control signal CS remains low, regardless of high or low state of the clock signal CLK.

Next, the operating procedure when the control signal CS of high and the clock signal CLK of low are inputted is described. If the control signal CS of high is inputted, the second transistor Q2 is turned on. If the second transistor Q2 is turned on, the gate high voltage VGH is divided and applied to the fourth and fifth resistors R4, R5. Consequently, a voltage difference (over a threshold voltage) is caused between the voltage applied to the fourth resistor R4 and the voltage applied to the emitter of the third transistor Q3, as a result of which the third transistor Q3 is turned on.

In addition, when the clock signal CS of low is inputted, the fifth transistor Q5 remains turned-off. Accordingly, the gate high voltage VGH is applied to the eighth resistor R8 and the emitter of the fourth transistor Q4, as a result of which the fourth transistor Q4 remains turned-off. Consequently, the driving voltage VDD is supplied to the output terminal Vout.

Next, the operating procedure when the control signal CS of high and the clock signal CLK of high are input is described. If the control signal CS of high is inputted, the second transistor Q2 is turned on. If the second transistor Q2 is turned on, the gate high voltage VGH is divided and applied to the fourth and fifth resistors R4, R5. Accordingly, a voltage difference (over a threshold voltage) is caused between the voltage applied to the fourth resistor R4 and the voltage applied to the emitter of the third transistor Q3, as a result of which the third transistor Q3 is turned on.

In addition, when the clock signal CS of high is inputted, the fifth transistor Q5 is turned on. If the fifth transistor Q5 is turned on, the gate high voltage VGH is divided and applied to the eighth and ninth resistors R8, R9. Accordingly, the fourth transistor Q4 is turned on by the voltage applied to the ninth resistor R9. If the fourth transistor Q4 is turned on in this manner, the gate high voltage VGH is applied to the output terminal Vout, that is, to the gate driving unit 6.

However, the above-mentioned conventional gate pulse modulator has a disadvantage in that because the output voltage Vout supplied to the gate driving unit 6 is completely square wave, a flicker phenomenon (flickering of a screen) is produced.

In addition, with the conventional gate pulse modulator, the gate high voltage VGH for use in the gate driving unit is outputted to the output terminal Vout, i.e., to the gate driving unit 6 only when the control signal CS remains in a high state. Moreover, the driving voltage VDD of a predetermined level is inputted to the gate driving unit when the control signal CS remains in a high state, that is, in the state where the output of the output terminal Vout does not practically drive the gate driving unit 6. Therefore, the gate driving unit has a problem of unnecessarily consuming a great amount of power.

Furthermore, the conventional gate pulse modulator employs the first resistor R1, the second resistor R2, the fourth resistor R4, the fifth resistor R5, the seventh resistor R7, the eighth resistor R8 and the ninth resistor R9 as voltage dividing resistors or the like which affect the operation of the gate driving unit 6. In other words, all the resistors will affect the operation of the gate driving unit 6, except the third resistor R3 and the resistor R6 which are used as protective resistors. Because these resistors have an error in the range of about 30% to 40%, there is a problem in that it is difficult for such a conventional gate pulse modulator to be integrated with a single semiconductor chip.

Referring to FIG. 3, three types of voltages are applied to the gate driving unit 6. That is, Vout of about 28V, Vcc of about 3.3V and VGL of about −5V are inputted to the gate driving unit 6 through the above-mentioned gate pulse modulator. At this time, since the Vcc and VGL cause no problem in operating a liquid crystal display device since they are inputted to the gate driving unit 6 with a length of time delay. However, the output voltage Vout inputted by the gate pulse modulator may cause a malfunction in the rendering of the liquid crystal display device because it is directly inputted to the gate driving unit 6 without any time delay. That is, referring to FIG. 3, because the output voltage Vout can be inputted at the same time with a time point B when the VGL is inputted or a time point A when the Vcc is inputted, the liquid crystal display device shall be malfunctioned. Theoretically, the output voltage Vout has to be inputted later than the time point B when the VGL is inputted about 400 ms so as to allow the liquid crystal display device to normally operate. However, there is a problem in that such a function cannot be implemented with a circuit.

BRIEF SUMMARY OF THE INVENTION

Therefore, an object of the present invention is to provide a gate pulse modulator which can minimize power consumption by allowing a base voltage to be supplied to a gate driving unit in a state in which both control signal and clock signal are in a low state.

Another object of the present invention is to provide a gate pulse modulator which can be easily fabricated in a single semiconductor chip by eliminating all voltage-dividing resistors adapted to supply a predetermined voltage to a transistor.

Still another object of the present invention is to provide a gate pulse modulator which can suppress a flicker phenomenon of a liquid crystal display panel and additionally prevent a latch-up phenomenon of a gate driving unit by rendering an output voltage inputted to a gate driving unit (that is, a gate high voltage) to decrease, not in a stepped pattern, but in an exponential pattern when the output voltage is lowered to a driving voltage.

Yet another object of the present invention is to prevent a malfunction of a liquid crystal display device by rendering an output voltage inputted to a gate driving unit (i.e., a gate high voltage) to be inputted after being delayed for a predetermined length of time as compared to Vcc or VGL.

In order to achieve the above-mentioned objects, there is provided a gate pulse modulator including: an input control unit receives inputs from a gate high signal terminal, a clock signal terminal, a control signal terminal and a base voltage source; and an output control unit connected to the gate high signal terminal, the control signal terminal, an external driving signal terminal and a base voltage source, wherein the output control unit outputs the base voltage of the base voltage source to a gate driving unit regardless of the clock signal when the control signal is low, and in the event of the control signal being high, the output control unit outputs the voltage of the gate high signal terminal if the clock signal is high, and the voltage of the driving signal terminal if the clock signal is low, to the gate driving unit.

Here, the input control unit includes: a first transistor with a base terminal thereof being connected to the clock signal terminal, so that the first transistor is turned on when the clock signal is in a high state; a second transistor with a base terminal, a collector terminal and an emitter terminal thereof being connected to the control signal terminal, the emitter terminal of the first transistor and the base voltage source, respectively, so that the second transistor is turned on when the control signal is in a high state; and a third transistor with a base terminal, a collector terminal and an emitter terminal thereof being connected to the clock signal terminal, the gate high signal terminal and the base voltage source, respectively, so that the third transistor is turned on when the clock signal is in a high state.

In addition, the output control unit includes: a fourth transistor with a base terminal and an emitter terminal thereof being connected to the collector terminal of the first transistor of the input control unit and the gate high signal terminal, respectively, so that the fourth transistor is turned on when the first and second transistors are turned on; a fifth transistor with a base terminal and a collector terminal thereof being connected to the collector terminal of the fourth transistor and the gate high signal terminal, respectively, so that the fifth transistor is turned on when the fourth transistor is turned on; a sixth transistor with a base terminal and a collector terminal thereof being connected to the collector terminal of the third transistor and the emitter terminal of the fifth transistor, respectively, so that the sixth transistor is also turned on when the third transistor is turned off and the fourth and fifth transistors are turned on; a seventh transistor with an emitter terminal, an collector terminal and a base terminal thereof being connected to the emitter terminal of the sixth transistor, the base voltage source and the external driving signal terminal, respectively, so that the seventh transistor is also turned on when the sixth transistor is turned on; an eighth transistor with a collector terminal, an emitter terminal and an base terminal thereof being connected to the gate high signal terminal, the base voltage source and the control signal terminal, respectively, so that the eighth transistor is turned on when the control signal is high; a ninth transistor with a collector terminal, an emitter terminal and a base terminal thereof being connected to the emitter terminal of the fifth transistor, the base voltage source and the collector terminal of the eighth transistor, respectively, so that the ninth transistor is turned on when the eighth transistor is turned off; and an output terminal commonly connected to the emitter terminal of the fifth transistor and the collector terminals of the sixth and ninth transistors, so that when the control signal is in a low state, the output terminal outputs the base voltage to the gate driving unit regardless of the clock signal, and in the event of the control signal being in a high state, the output terminal outputs the voltage of the driving signal terminal if the clock signal is low and the voltage of the gate high signal terminal if the clock signal is high, to the driving unit.

A time delay unit may be additionally connected to the input control unit, so that the voltage of the gate high signal terminal is outputted after being delayed for a predetermined length of time.

In addition, a discharge resistor may be additionally connected to the time delay unit so as to enable to forcibly discharge a time delay capacitor.

Moreover, a time constant adjusting capacitor and a time constant adjusting resistor may be additionally connected to the output control section so that the gate high voltage decreases in an exponential pattern for a predetermined length of time when the gate high voltage is lowered to the driving voltage in the output terminal.

The present invention will be more apparent from the following detailed description taken in conjunction with the accompanying drawings.

BRIEF DESCRIPTION OF DRAWINGS

Common reference numerals are used throughout the drawings and detailed description to indicate the same elements.

DETAILED DESCRIPTION OF EMBODIMENTS

Now, the preferred embodiments of the present invention will be described in detail with reference to the accompanying drawings so that one ordinarily skilled in the art can readily embody the present invention.

Figure 1:
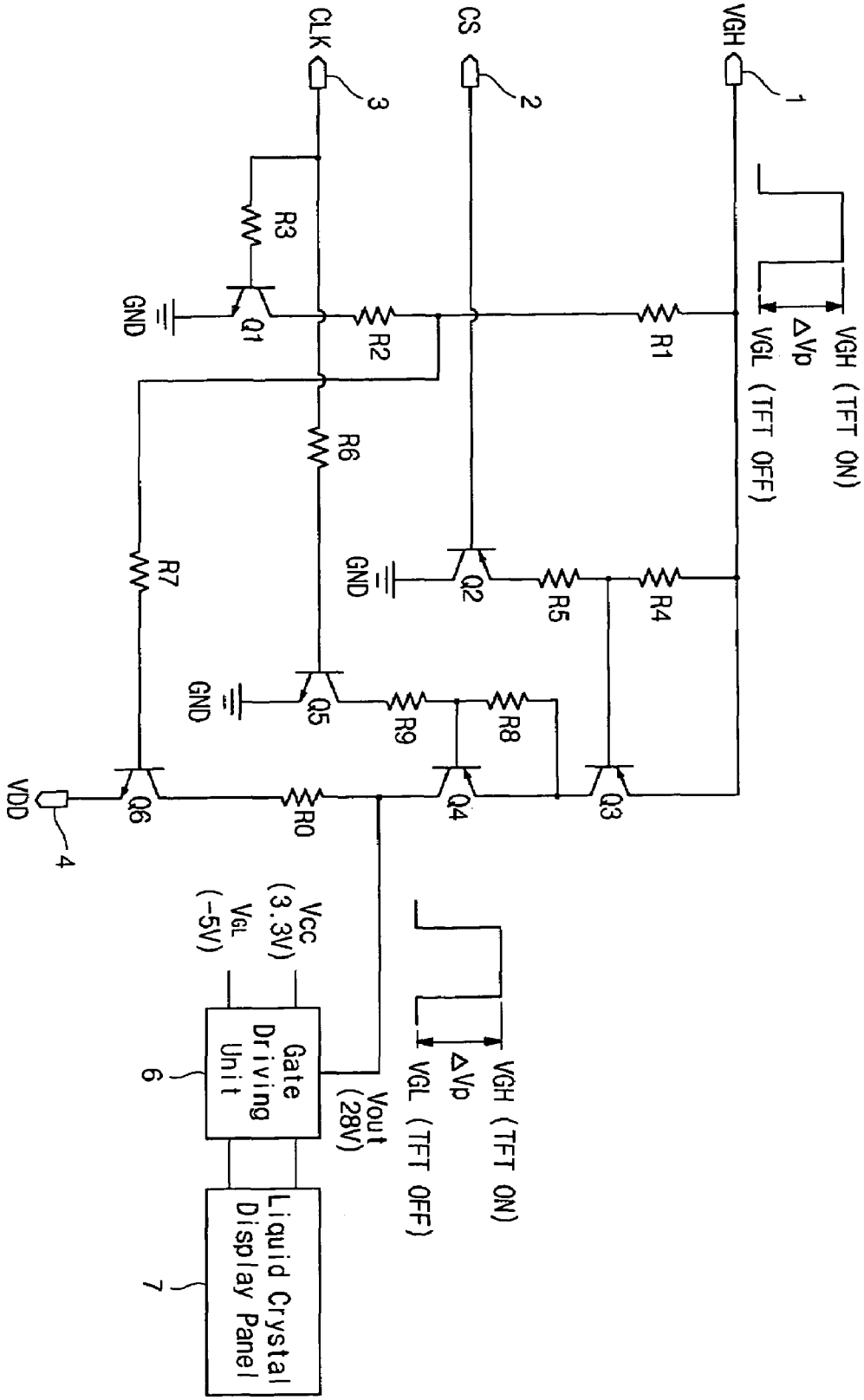
FIG. 1 is a circuit diagram showing a conventional gate pulse modulator.
Figure 2:
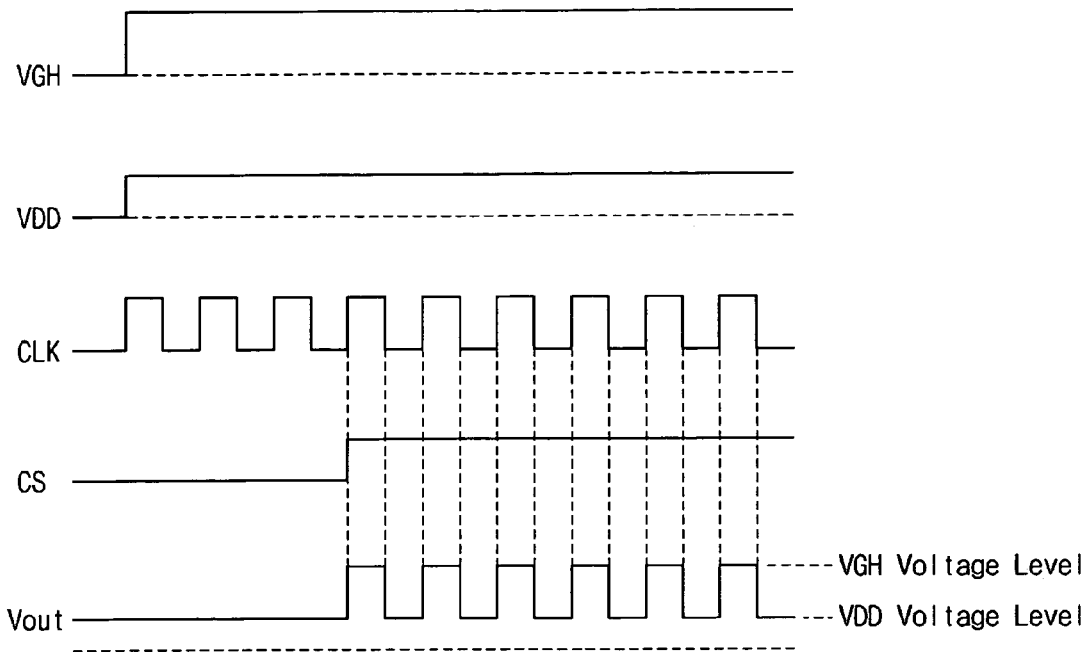
FIG. 2 is a waveform diagram showing the waveforms of a gate high signal, a driving signal, a clock signal, a control signal and an output signal in the gate pulse modulator of FIG. 1.
Figure 3:
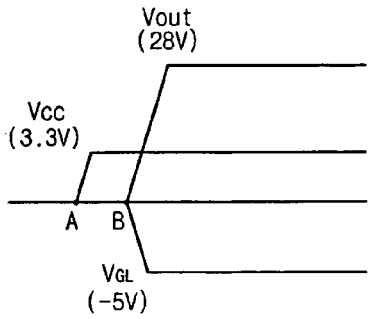
FIG. 3 is a waveform diagram showing the voltages inputted to the gate driving unit of FIG. 1.
Figure 4:
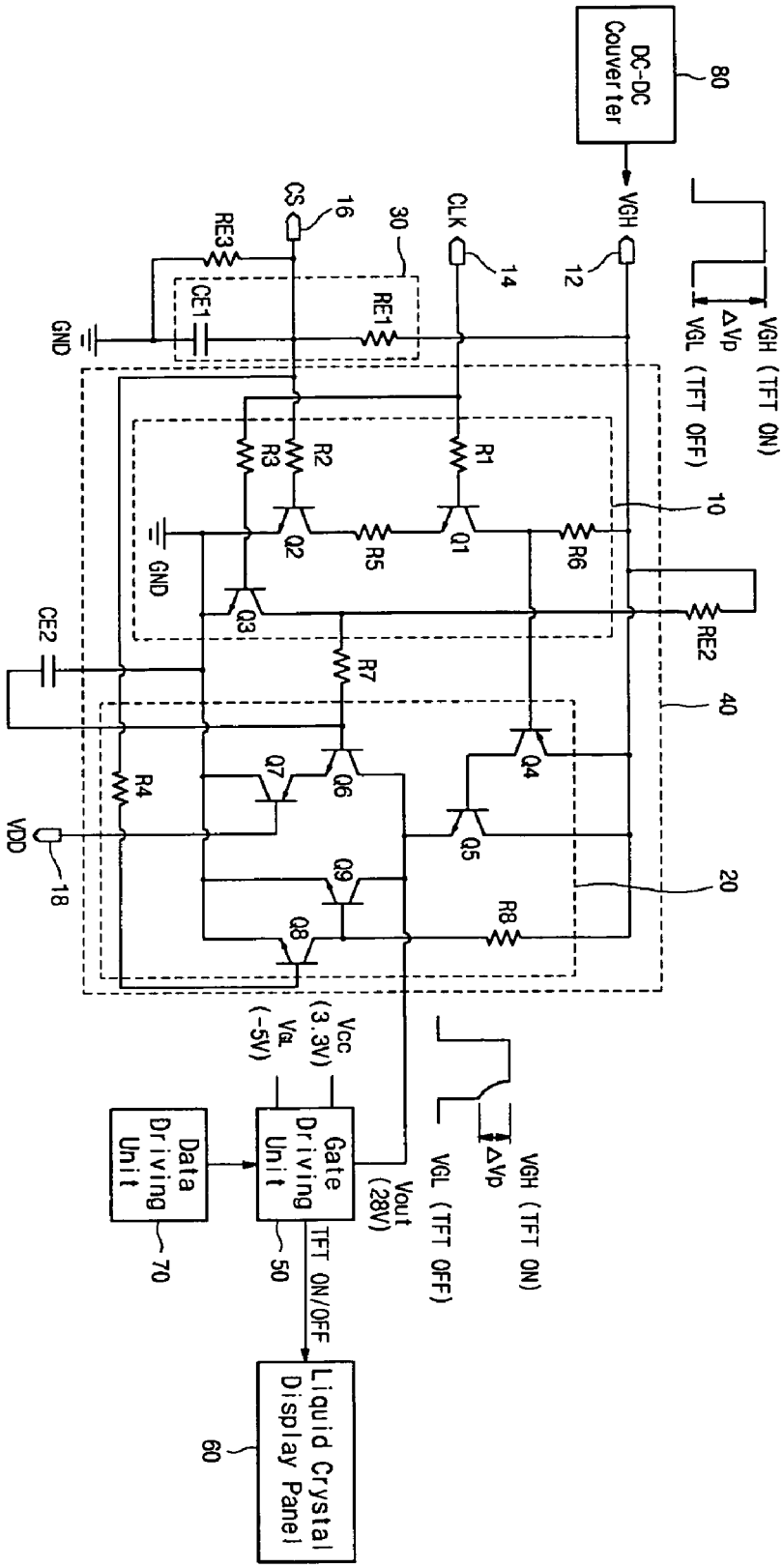
FIG. 4 is a circuit diagram showing the inventive gate pulse modulator.

Referring to FIG. 4, there is shown a circuit diagram of the inventive gate pulse modulator.

As shown in the drawings, the inventive gate pulse modulator includes in general an input control unit 10, a resistor (seventh resistor R7), an output control unit 20, and a time delay unit 30, wherein a gate driving unit 50 is connected to the output control unit 20.

Here, reference numeral 60 indicates a liquid crystal display panel connected to the gate driving unit 50, reference numeral 70 indicates a data driving unit for providing a time and logic for the liquid crystal display panel 60, and reference numeral 80 indicates a DC-DC converter for outputting a gate high voltage VGH.

Firstly, the input control unit 10 is adapted to be capable for receiving inputs from a gate high signal terminal 12, a clock signal terminal 14 and a control signal terminal 16. That is, the input control unit 10 has a first transistor Q1 with an emitter terminal thereof being connected to clock signal terminal 14, so that the first transistor Q1 is turned on when the clock signal is in a high state. In addition, the input control unit 10 has a second transistor Q2 with a base terminal, a collector terminal and an emitter terminal thereof being connected to the control signal terminal 16, the emitter terminal of the first transistor Q1 and a base voltage source GND, respectively, so that the second transistor Q2 is turned on when the control signal CS is in a high state. Further, the input control unit 10 has a third transistor Q3 with a base terminal, a collector terminal and an emitter terminal thereof being connected to the clock signal terminal 14, the gate high signal terminal 12 and the base voltage source GND, respectively, so that the third transistor is turned on when the clock signal CLK is in a high state.

Here, a first transistor-protective resistor R1 is interconnected between the clock signal terminal 14 and the base terminal of the first transistor Q1. In addition, there is also provided a second transistor-protective resistor R2 interconnected between the control signal terminal 16 and the base terminal of the second transistor Q2. Further, a third transistor-protective resistor R3 is interconnected between the clock signal terminal 14 and the third transistor Q3. Still yet, a fifth transistor-protective resistor R5 is interconnected between the emitter terminal of the first transistor Q1 and the collector terminal of the second transistor Q2. Moreover, a sixth transistor-protective resistor R6 is interconnected between the collector terminal of the first transistor Q1 and the gate high signal terminal 12. All of the first to third transistors Q1, Q2, Q3 may be NPN type transistors.

Next, the output control unit 20 is adapted to receive inputs of the gate high voltage VGH, the clock signal CLK, the control signal CS, the base voltage GND and the external driving voltage VDD from the input control unit 10 and thereby to output anyone among the gate high voltage VGH, the clock signal CLK, the control signal CS, the base voltage GND and the external driving voltage VDD to the gate driving unit 50. That is, the output control unit 20 has a fourth transistor Q4 with a base terminal thereof being interconnected between the collector terminal of the first transistor Q1 of the input control unit 10 and the sixth protective resistor R6 and an emitter terminal thereof being connected to the gate high signal terminal 12, so that the fourth transistor is turned on when the first and second transistors Q1, Q2 are turned on. The output control unit 20 also has a fifth transistor Q5 with a base terminal and a collector terminal thereof being connected to the collector terminal of the fourth transistor Q4 and the gate high signal terminal 12, respectively, so that the fifth transistor Q5 is turned on when the fourth transistor Q4 is turned on. In addition, the output control unit 20 also has a sixth transistor Q6 with a base terminal and a collector terminal thereof being connected to the collector terminal of the third transistor Q3 and the emitter terminal of the fifth transistor Q5, respectively, so that the sixth transistor Q6 is turned on when the third transistor Q3 is turned off and the fifth transistor Q5 is turned on. Further, the output control unit 20 has a seventh transistor Q7 with an emitter terminal, a collector terminal and a base terminal thereof being connected to the emitter terminal of the sixth transistor Q6, the base voltage source GND and the external driving signal terminal 18, respectively, so that the seventh transistor Q7 is also turned on when the sixth transistor Q6 is turned on. Moreover, the output control unit 20 also has an eighth transistor Q8 with a collector terminal, an emitter terminal and a base terminal thereof being connected to the gate high signal terminal 12, the base voltage source GND and the control signal terminal 16, respectively, so that the eighth transistor Q8 is turned on when the control signal CS is high. Still, the output control unit 20 also has a ninth transistor Q9 with a collector terminal, an emitter terminal and a base terminal thereof being connected to the emitter terminal of the fifth transistor Q5, the base voltage source GND and the collector terminal of the eighth transistor Q8, respectively, so that the ninth transistor Q9 is turned on when the eighth transistor Q8 is turned off. Still yet, the output control unit 20 has an output terminal Vout commonly connected to the emitter terminal of the fifth transistor Q5 and the collector terminals of the sixth and ninth transistors Q6, Q9, thereby outputting one of the base voltage GND, driving voltage VDD and gate high voltage VGH to the gate driving unit 50.

Here, the output voltage Vout inputted to the gate driving unit 50, that is, into the gate high voltage VGH (TFT ON) may be about 28V, the Vcc inputted to the gate driving unit 50 may be about 3.3V, and the VGL (TFT OFF) inputted to the gate driving unit 50 may be about −5V. However, the present invention is not limited to this. In addition, the fifth, sixth, eighth and ninth transistors Q5, Q6, Q8, and Q9 may be NPN type transistors and the fourth and seventh transistors Q4, Q7 may be PNP type transistors.

In addition, the output control unit 20 further includes an eighth transistor-protective resistor R8 for protecting the eighth and ninth transistors Q8, Q9 interconnected between the gate high signal terminal 12 and the collector terminal of the eighth transistor Q8. Moreover, the output control unit 20 includes a fourth transistor-protective resistor R4 interconnected between the base terminal of the eighth transistor Q8 and the control signal terminal 16.

Meanwhile, one end of a seventh resistor R7 for controlling the output unit is commonly connected to the gate high signal terminal 12 and the collector terminal of the third transistor Q3 and the other end is connected to the base terminal of the sixth transistor Q6, thereby affecting the operation of the output control unit 20. Therefore, in the present invention, the first R1 to sixth R6 resistors, and eighth resistors R8 are provided for protecting transistors and the remaining seventh resistor R7 is provided for affecting the control of the output unit, whereby the input control unit 10, the output control unit 20 and the seventh resistor R7 can be easily integrated with a single semiconductor chip or integrated circuit 40.

In addition, the time delay unit is interconnected between the gate high signal terminal 12 and the base voltage source GND, so that the output voltage Vout inputted to the gate driving unit 50, i.e., the gate high voltage VGH can be delayed for a predetermined length of time. That is, the time delay unit 30 includes a resistor RE1 interconnected between the gate high signal terminal 12 and the control signal terminal 16, and a capacitor CE1 interconnected between the control signal terminal 16 and the base voltage source GND. Of course, one end of the capacitor CE1 is commonly connected to the control signal terminal 16 and the resistor RE1 and the other end is connected to the base voltage source GND. This time delay unit 30 can output the gate high voltage VGH after delaying it about 300 to 500 ms and enable the value of the resistor RE1 or capacitor CE1 to be varied, so that a user can optionally adjust the length of delay time. Although such a time delay unit 30 can be integrated into the signal integrated circuit 40, it is preferred to separately connect the time delay unit 30 to the outside of the integrated circuit 40 because the capacitance of the capacitor CE1 is very large.

Meanwhile, the time delay unit 30 may abnormally operate if the supply of the gate high voltage VGH is interrupted due to a certain reason while charging or discharging the capacitor CE1 and then the gate high voltage VGH is supplied. This is caused because the capacitor CE1 of the time delay unit 30 has not been initialized. Therefore, the present invention provides a discharge resistor RE3 interconnected between the control signal terminal 16 and the base voltage source GND to forcibly discharge and initialize the capacitor CE1. Of course, the discharge resistor RE3 is connected to the capacitor CE1 in parallel. Accordingly, even if the supply of the gate high voltage VGH is interrupted due to a certain reason and then the gate high voltage VGH is supplied, the resistor RE3 initializes the capacitor CE1, whereby the time delay unit 30 can normally operate. Of course, with this resistor RE3, the range of usable capacitance of the capacity CE1 can be extended. Moreover, it is possible to provide the time delay resistor RE1, the time delay capacitor CE1 and the discharge resistor RE3 outside of the integrated circuit 40, so that a user can optionally adjust the length of delay time.

Moreover, a time constant adjusting resistor RE2 is additionally interconnected between the gate high signal terminal 12 and the seventh resistor R7, and a time constant adjusting capacitor CE2 is additionally interconnected between the base terminal of the sixth transistor Q3 and the base voltage source GND.

Therefore, the gate high voltage through the output terminal Vout decreases not in a stepped pattern but in an exponential pattern for a predetermined length of time by the time constant adjusting resistor RE2 and capacitor CE2. That is, when the gate high voltage drops to the driving voltage, the gate high voltage decreases not abruptly but exponentially for a predetermined length of time. Of course, if the time constant adjusting resistor RE2 and the time constant adjusting capacitor CE2 are formed outside of the integrated circuit 40, the user can optionally adjust the time constant.

Figure 5:
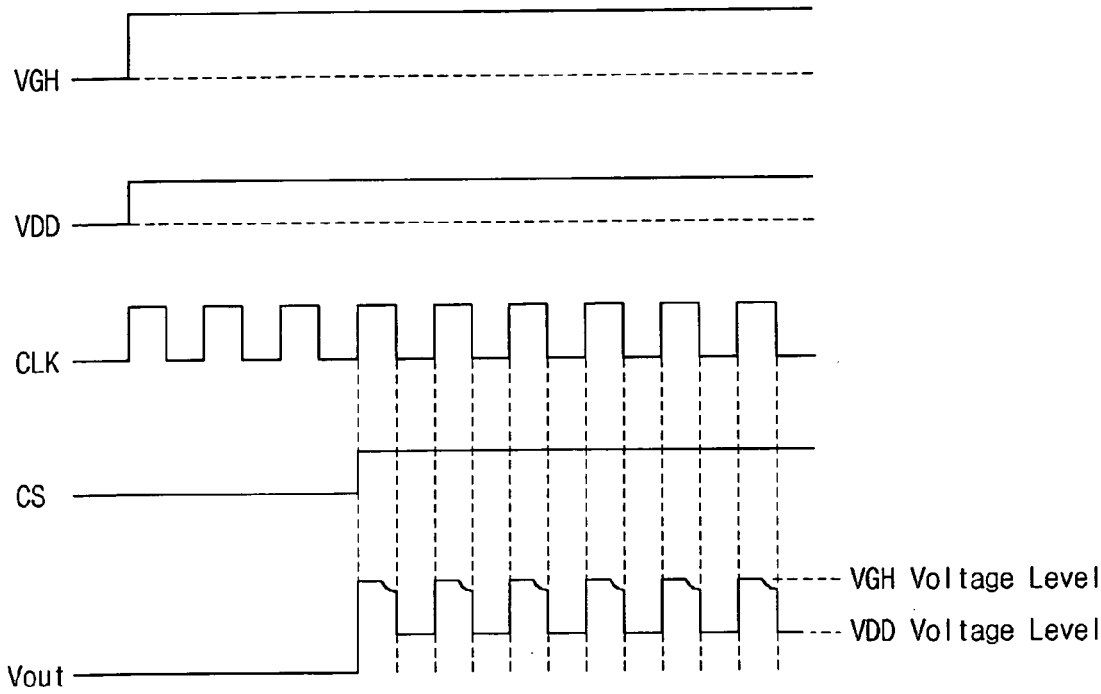
FIG. 5 is a waveform diagram showing the waveforms of a gate high signal, a driving signal, a clock signal, a control signal and an output signal in the gate pulse modulator of FIG. 4.
Figure 6:
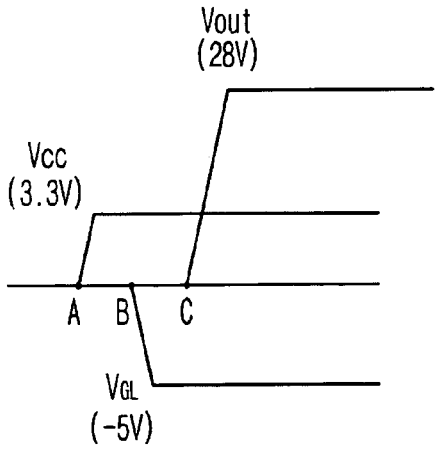
FIG. 6 is a waveform diagram showing the voltages inputted to the gate driving unit of FIG. 4.

Now, the operation of the inventive gate pulse modulator configured as described above is described with reference to the circuit diagram of FIG. 4, the waveform diagram of FIG. 5 and the waveform diagram of FIG. 6.

Here, the description for the operation of the inventive gate pulse modulator will be divisionally made for the first case in which the control signal CS of low and the clock signal CLK of low are inputted, the second case in which the control signal CS of low and the clock signal CLK of high are inputted, the third case in which the control signal CS of high and the clock signal CLK of high are inputted, and the fourth case in which the control signal CS of high and the clock signal CLK of low are inputted.

Firstly, description is made for the case in which the control signal CS of low and the clock signal CLK of low are inputted.

The control signal CS of low according to the control signal terminal 16 is inputted to the base terminal of the second transistor Q2 via the second resistor R2 in the input control unit 10 and simultaneously inputted to the base terminal of the eighth transistor Q8 via the fourth resistor R4 in the output control unit 20. Then, the second transistors Q2 and the eighth transistor Q8 that have received the control signal of low are turned off.

In addition, the clock signal CLK of low according to the clock signal terminal 14 is inputted to the base terminal of the first transistor Q1 via the first resistor R1 in the input control unit 10 and simultaneously inputted to the base terminal of the third transistor Q3 via the third resistor R3. Then, the first transistor Q1 and the third transistor Q3 that have received the clock signal CLK of low are turned off.

Meanwhile, if the first transistor Q1 of the input control unit 10 is turned off, the gate high voltage VGH is inputted to the base terminal of the fourth transistor Q4 of the output control unit 20 through the sixth resistor R6. Therefore, the fourth transistor Q4 of PNP type that has received the gate high voltage VGH at the emitter terminal thereof remains turned-off. That is, the fourth transistor Q4 does not operate. In addition, if the fourth transistor Q4 is in a turned-off state, the fifth transistor Q5 of NPN type naturally remains turned-off.

In addition, because the eighth transistor Q8 of the output control unit 20 is in the turned-off state as described above, the gate high voltage VGS is inputted to the base terminal of the ninth transistor Q9 via the eighth resistor R8. Accordingly, the ninth transistor Q9 becomes turned-on state. Of course, if the ninth transistor Q9 is turned on as described above, the output terminal Vout is connected to the base voltage source GND. That is, the base voltage GND is outputted to the gate driving unit 50. Meanwhile, the third transistor Q3 is in the turned-off state as described above, the gate high voltage VGH is inputted to the base terminal of the sixth transistor Q6 via the time constant adjusting resistor RE2 and the seventh resistor R7. Consequently, the sixth transistor Q6 is turned on. At this time, the seventh transistor Q7 of PNP type remains turned-off as the driving signal terminal 19 is connected to the base terminal thereof, as a result of which only the base voltage GND is outputted to the output terminal Vout. That is, the base voltage GND is inputted to the gate driving unit 50.

Thus, if the control signal CS of low and the clock signal CLK of low are inputted, the output terminal Vout, i.e., the gate driving unit 50 is only provided with the base voltage GND.

Secondly, description is made in terms of the case in which the control signal CS of low and the clock signal CLK of high are inputted.

The control signal CS of low according to the control signal terminal is inputted to the base terminal of the second transistor Q2 via the second resistor R2 of the input control unit 10 and simultaneously inputted to the base terminal of the eighth transistor Q8 via the fourth resistor R4 of the output control unit 40. Consequently, the second transistor Q2 and the eighth transistor Q8 that have received the control signal CS of low are turned off.

The clock signal CLK of high according to the clock signal terminal 14 is inputted to the base terminal of the first transistor Q1 via the first resistor R1 of the input control unit 10 and simultaneously inputted to the base terminal of the third transistor Q3 via the third resistor R3. Consequently, the first transistor Q1 and the third transistor Q3 are turned on.

Meanwhile, because the second transistor Q2 is in the turned-off state as described even if the first transistor Q1 is turned on, the gate high voltage VGH is applied to the sixth resistor R6, whereby the fourth transistor Q4 of PNP type is remains turned-off. That is, the fourth transistor Q4 does not operate. In addition, if the fourth transistor Q4 is turned off, the fifth transistor Q5 is also turned off.

In addition, the gate high voltage VGH is applied to the eighth resistor R8 and the gate high voltage VGH applied to the eighth resistor R8 is directly inputted to the base terminal of the ninth transistor Q9 because the eighth transistor Q8 is in the turned-off state. Consequently, the ninth transistor Q9 is turned on. If the ninth transistor Q9 is turned on, the base voltage is outputted through the output terminal Vout. That is, the gate driving unit 50 is inputted with the base voltage GND.

Further, because the third transistor Q3 is in a turned-on state, the gate high voltage VGH is turned to the base voltage GND. That is, the sixth transistor Q6 is in the turned-off state and thus only the base voltage GND is outputted through the output terminal Vout.

In conclusion, if the control signal CS of low and the clock signal CLK of high are inputted, only the base voltage GND is outputted through the output terminal Vout.

Therefore, when the control signal CS of low is inputted, the inventive gate pulse modulator outputs the base voltage GND through the output terminal Vout regardless of whether the clock signal CLK is low or high. In other words, the present invention can minimize power consumption by outputting the base voltage GND without outputting the driving voltage VDD at all.

Thirdly, description is made in terms of the case in which the control signal CS of high and the clock signal CLK of high are inputted.

The control signal CS of high through the control signal terminal 16 is inputted to the base terminal of the second transistor Q2 via the second resistor R2 of the input control unit 10 and simultaneously inputted to the base terminal of the eighth transistor Q8 via the fourth resistor R4 of the output control unit 20. Consequently, the second transistor Q2 and the eighth transistor Q8 that have received the control signal CLK of high are turned on.

The clock signal CLK of high through the clock signal terminal 14 is inputted to the base terminal of the first transistor Q1 via the first resistor R1 and inputted to the base terminal of the third transistor Q3 via the third resistor R3. Consequently, the first transistor Q1 and the third transistor Q3 that have received the clock signal CLK of high are turned on.

If the first transistor Q1 and the second transistor Q2 are turned on as described above, a voltage lower than the gate high voltage VGH is applied to the base terminal of the fourth transistor Q4, whereby the fourth transistor Q4 is turned on. If the fourth transistor Q4 is turned on, the gate high voltage VGH is also applied to the base terminal of the fifth transistor Q5, whereby the fifth transistor Q5 is turned on. In addition, if the fifth transistor Q5 is turned on, the gate high voltage VGH is outputted through the output terminal Vout. That is, the gate driving unit 50 is inputted with the gate high voltage VGH.

Here, the gate high voltage VGH is outputted after being delayed for a length of time corresponding to a time constant determined by the resistor RE1 and the capacitor CE1 of the time delay unit 30. That is, the output voltage Vout, i.e., the gate high voltage VGH is inputted to the gate driving unit after being delayed by a predetermined length of time as compared to the Vcc and VGL inputted to the gate driving unit 50, whereby the malfunction of the liquid crystal display panel 60 and the latch-up phenomenon of the gate driving unit 50 can be prevented. It is possible to adjust the values of the resistor RE1 and the capacitor CE1 of the time delay unit 30 so that the time delay becomes about 300 to 500 ms. Further, the present invention allows the values of the resistor RE1 and the capacitor CE1 to be variably adjusted, so that a user can adjust the delay time, thereby enabling the display condition of the liquid crystal display device to be optimized.

Moreover, a discharge resistor RE3 is interconnected between the control signal terminal 16 and the base voltage source. Therefore, even if the supply of the gate high voltage is interrupted due to a certain reason and then resumed prior to the complete discharge of the above-mentioned capacitor CE1, the capacitor CE1 is initialized, whereby the time delay unit 30 can normally operate. Of course, the range of the usable capacitance of the capacitor CE1 can be extended by this resistor RE3.

Meanwhile, because the third transistor Q3 is in a turned-on state as described above, no voltage is applied to the base terminal of the sixth transistor Q6, whereby the sixth transistor Q6 is turned off. In addition, the eighth transistor Q8 is in a turned-on state, no voltage is also applied to the base terminal of the ninth transistor Q9, whereby the ninth transistor Q9 is turned off. Consequently, only the gate high voltage VGH is outputted through the output terminal Vout. That is, the gate driving unit 50 is only inputted with the gate high voltage VGH.

Therefore, according to the present invention, if the control signal CS of high and the clock signal CLK of high are inputted, only the gate high voltage delayed for a predetermined length of time is supplied to the output Vout, that is, to the gate driving unit, whereby, the malfunction of the liquid crystal display device can be prevented.

Fourthly, description is made in terms of the case in which the control signal CS of high and the clock signal CLK of low are inputted.

The control signal CS of high is inputted to the base terminal of the second transistor Q2 via the second resistor R2 of the input control unit 10 and simultaneously inputted to the base terminal of the eighth transistor Q8 via the fourth resistor R4 of the output control unit 20. Consequently, the second transistor Q2 and the eighth transistor Q9 that have received the control signal CS of high are turned on.

In addition, the clock signal CLK of low is inputted to the base terminal of the first transistor Q1 via the first resistor R1 of the input control unit 10 and inputted to the base terminal of the third transistor Q3 via the third resistor R3. Consequently, the first transistor Q1 and the third transistor Q3 that have received the clock signal CLK of low are turned off.

Furthermore, if the first transistor Q1 is turned off as described above, the fourth transistor Q4 of PNP type and the fifth transistor Q5 of NPN type are also turned off. And, if the eighth transistor Q8 is turned on as described above, the ninth transistor Q9 is turned off, because no voltage is applied to the base of the ninth transistor Q9. Moreover, if the third transistor Q3 is turned off as described above, the gate high voltage VGH is applied to the base of the sixth transistor Q6 via the time constant adjusting resistor RE2 and the seventh resistor R7, whereby the sixth transistor is turned on.

If the sixth transistor Q6 is turned on as described above, the gate high voltage VGH is applied to the emitter terminal of the seventh transistor Q7 of PNP type, of which the base terminal the driving voltage VDD is applied to. Accordingly, the seventh transistor Q7 is turned on, whereby the gate high voltage VHG is lowered to the driving voltage VDD.

In other words, the seventh transistor Q7 is turned off by the difference between the gate high voltage VGH supplied to its emitter terminal and the driving voltage VDD supplied to its base terminal. At this time, the gate high voltage VGH is supplied to the base voltage source GND. Thereafter, if the gate high voltage VGH and the driving voltage VDD do not exceed a threshold voltage, the seventh transistor Q7 is turned off. At this time, a voltage (roughly the driving voltage), that equals to the driving voltage VDD plus the threshold voltage, is applied to the emitter terminal of the seventh transistor Q7. Accordingly, the driving voltage VDD is outputted through the output terminal Vout (In fact, a voltage that equals to the driving voltage+Q7 voltage VCE (threshold voltage) appears at the output terminal).

Therefore, according to the present invention, if the control signal CS of high and the clock signal CLK of low are inputted, the driving voltage VDD lower than the gate high voltage is supplied to the output terminal, whereby the liquid crystal display device can be appropriately operated.

Here, the moment when the clock signal CLK is turned from high state to low state is more specifically described.

At first, if the clock signal CLK of low is inputted and thus the third transistor Q3 is turned off, the gate high voltage VGH is applied to the base terminal of the sixth transistor Q6 via the time constant adjusting resistor RE2 and the seventh resistor R7. That is, a voltage somewhat lower than the gate high voltage is applied to the base terminal of the sixth transistor Q6. At this time, however, a base current is applied to the base of the sixth transistor Q6 later by the time constant by the effects of the time constant adjusting resistor RE2 and the time constant adjusting capacitor CE2. Therefore, the seventh transistor Q7 of PNP type is also turned off later by the time constant. Consequently, as the seventh transistor Q7 is turned off later by the time constant, the gate high voltage VGH decreases not in a stepped pattern but in an exponential pattern within a predetermined area. That is, the gate high voltage exponentially is turned to the driving voltage VDD while decreasing for a value corresponding to $\Delta Vp$. As gate high voltage VGH decreases not in a stepped pattern but in an exponential pattern in this manner, the flicker phenomenon of the liquid crystal display panel 60 can be completely suppressed.

In conclusion, when the control signal CS of low and the clock signal CLK of low are inputted to the inventive gate pulse modulator, the base voltage GND is supplied to the output terminal Vout, i.e., to the gate driving unit 50.

When the control signal CS of low and the clock signal CLK of high are inputted to the inventive gate pulse modulator, the base voltage GND is supplied to the output terminal Vout, i.e., to the gate driving unit 50.

When the control signal CS of high and the clock signal CLK of high are inputted to the inventive gate pulse modulator, the gate high voltage VGH is supplied to the output terminal Vout, i.e., to the gate driving unit 50 after being delayed for a predetermined length of time, whereby the malfunction of the liquid crystal display device can be surely prevented.

When the control signal CS of high and the clock signal CLK of low are inputted to the inventive gate pulse modulator, the driving voltage VDD lower than the gate high voltage VGH is supplied to the output terminal Vout, i.e., to the gate driving unit 50, whereby the liquid crystal display device can be appropriately operated.

With the inventive gate pulse modulator, the output voltage Vout inputted to the gate driving unit 50 is inputted later than Vcc and VGL about 300 to 500 ms, whereby it is possible to prevent the malfunction of the liquid crystal display panel 60 and to suppress the latch-up phenomenon.

Moreover, with the inventive gate pulse modulator, the gate high voltage exponentially decreases within a predetermined area when the gate high voltage is lowered to the level of driving voltage, whereby the flicker phenomenon of the liquid crystal display panel 60 can be completely removed. Of course, the time constant adjusting resistor RE2 and capacitor CE2 are provided outside of the integrated circuit 40, whereby the user can optionally adjust charging and discharging time constants.

According to the present invention, because the values of the resistor RE1 and capacitor CE1 of the time delay unit are variable, the user can directly adjust the length of delay time to optimize the displaying condition of the liquid crystal display device. In addition, as the discharge resistor RE3 is additionally provided in the inventive gate pulse modulator, the output voltage Vout is outputted with a correct length of delay time even if the supply of the gate high voltage VGH is interrupted due to a certain reason and then resumed.

Furthermore, according to the present invention, the input control unit, resistor R7 and output control unit can be implemented with a single integrated circuit, where the entire size of the device can be largely reduced.

Moreover, the present invention not only enables a wide range of electric voltage to be applied, so that the inventive gate pulse modulator is applicable to all kinds of liquid crystal display devices, but also allows such a gate pulse modulator to be designed in a super-mini size, so that it is suitable for a portable appliance.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process, may be implemented by one skilled in the art in view of this disclosure.

What is claimed is:

1. A gate pulse modulator comprising:

an input control unit receiving inputs from a gate high signal terminal, a clock signal terminal, a control signal terminal and a base voltage source; and an output control unit connected to the gate high signal terminal, the control signal terminal, an external driving signal terminal and a base voltage source, wherein the output control unit outputs a base voltage of the base voltage source to a gate driving unit regardless of the clock signal when the control signal is low, outputs a voltage of the gate high signal terminal to the gate driving unit when the control signal is high and the clock signal is high, and outputs a voltage of the driving signal terminal to the gate driving unit when the control signal is high and the clock signal is low.

2. A gate pulse modulator as claimed in claim 1, further comprising a time delay unit interconnected between the gate high signal terminal and the base voltage source, so that the output voltage inputted to the gate driving unit is delayed for a predetermined length of time.

3. A gate pulse modulator as claimed in claim 2, wherein the time delay unit comprises a time delay resistor interconnected between the gate high signal terminal and the control signal terminal, and a time delay capacitor interconnected between the control signal terminal and the base voltage source.

4. A gate pulse modulator as claimed in claim 3, further comprising a discharge resistor interconnected between the control signal terminal and the base voltage source to enable the capacitor to be discharged.

5. A gate pulse modulator as claimed in claim 1, wherein the voltage of the gate high signal terminal is set to be higher than the voltage of the driving signal terminal.

6. A gate pulse modulator as claimed in claim 1, further comprising a resistor for controlling the output control unit interconnected between the input control unit and the output control unit.

7. A gate pulse modulator as claimed in claim 1, wherein the input control unit comprises:

a first transistor with a base terminal thereof being connected to the clock signal terminal, so that the first transistor is turned on when the clock signal is in a high state;

a second transistor with a base terminal, a collector terminal and an emitter terminal thereof being connected to the control signal terminal, the emitter terminal of the first transistor and the base voltage source, respectively, so that the second transistor is turned on when the control signal is in a high state; and a third transistor with a base terminal, a collector terminal and an emitter terminal thereof being connected to the clock signal terminal, the gate high signal terminal and the base voltage source, respectively, so that the third transistor is turned on when the clock signal is in a high state.

8. A gate pulse modulator as claimed in claim 7, wherein a first resistor is interconnected between the base terminal of the first transistor and the clock signal terminal, a second resistor is interconnected between the base terminal of the second transistor and the control signal terminal, a third resistor is interconnected between the base terminal of the third transistor and the clock signal terminal, a fifth resistor is interconnected between the emitter terminal of the first transistor base and the collector terminal of the second transistor, and a sixth resistor is interconnected between the collector terminal of the first transistor and the gate high signal terminal.

9. A gate pulse modulator as claimed in claim 8, wherein the time delay resistor of the time delay unit is interconnected between the gate high signal terminal and the second resistor, and the time delay capacitor of the time delay unit is commonly connected to the time delay resistor and the control signal terminal and connected to the base voltage source.

10. A gate pulse modulator as claimed in claim 7, wherein the output control unit comprises:

a fourth transistor with a base terminal and an emitter terminal thereof being connected to the collector terminal of the first transistor of the input control unit and the gate high signal terminal, respectively, so that the fourth transistor is turned on when the first and second transistors are turned on;

a fifth transistor with a base terminal and a collector terminal thereof being connected to the collector terminal of the fourth transistor and the gate high signal terminal, respectively, so that the fifth transistor is turned on when the fourth transistor is turned on;

a sixth transistor with a base terminal and a collector terminal thereof being connected to the collector terminal of the third transistor and the emitter terminal of the fifth transistor, respectively, so that the sixth transistor is turned on when the third transistor is turned off and the fourth and fifth transistors are turned on;

a seventh transistor with an emitter terminal, a collector terminal and a base terminal thereof being connected to the emitter terminal of the sixth transistor, the base voltage source and the external driving signal terminal, respectively, so that the seventh transistor is also turned on when the sixth transistor is turned on;

an eighth transistor with a collector terminal, an emitter terminal and a base terminal thereof being connected to the gate high signal terminal, the base voltage source and the control signal terminal, respectively, so that the eighth transistor is turned on when the control signal is high;

a ninth transistor with a collector terminal, an emitter terminal and a base terminal thereof being connected to the emitter terminal of the fifth transistor, the base voltage source and the collector terminal of the eighth transistor, respectively, so that the ninth transistor is turned on when the eighth transistor is turned off; and an output terminal commonly connected to the emitter terminal of the fifth transistor and the collector terminals of the sixth and ninth transistors, so that when the control signal is in a low state, the output terminal outputs the base voltage to the gate driving unit regardless of the clock signal, and in the event of the control signal is in a high state, the output terminal outputs the voltage of the driving signal terminal if the clock signal is low, and the voltage of the gate high signal terminal if the clock signal is high, to the gate driving unit.

11. A gate pulse modulator as claimed in claim 10, wherein a seventh resistor for controlling the output control unit is interconnected between the gate high signal terminal and the base terminal of the sixth transistor.

12. A gate pulse modulator as claimed in claim 10, wherein a fourth resistor is interconnected between the base terminal of the eighth transistor and the control signal terminal, and an eighth resistor is interconnected between the collector terminal of the eighth transistor and the gate high signal terminal.

13. A gate pulse modulator as claimed in claim 10, wherein when the signal of the control signal terminal is in a low state, the second transistor of the input control unit, is turned off and the fourth and fifth transistors of the output control unit are also turned off, so that the gate high voltage is not supplied to the output terminal, and the eighth transistor of the output control unit is turned off and the ninth transistor is turned on, so that the base voltage of the base voltage source is outputted to the output terminal.

14. A gate pulse modulator as claimed in claim 10, wherein when the signals of the control signal terminal and the clock signal terminal are in a high state, in the input control unit, the first, second and third transistors are turned off, and in the output control unit, the fourth, fifth and eighth transistors are turned on and the sixth and ninth transistors are turned off, so that the gate high signal voltage of the gate high signal terminal is outputted to the output terminal.

15. A gate pulse modulator as claimed in claim 10, wherein when the signal of the control signal terminal is in a high state and the signal of the clock signal terminal is in a low state, in the input control unit, the first and third transistors are turned off and the second transistor is turned on, and in the output control unit, the fourth and fifth transistors are turned off, the sixth and seventh transistors are turned on, the eighth transistor is turned on and ninth transistor is turned off, so that the driving voltage of the driving signal terminal is outputted to the output terminal.

16. A gate pulse modulator as claimed in claim 6, wherein the input control unit, the output control unit and the resistor for controlling the output control unit are formed in a single integrated circuit.

17. A gate pulse modulator as claimed in claim 3, wherein the time delay unit outputs the voltage of the gate high signal terminal after delaying it about 300 to 500 ms.

18. A gate pulse modulator as claimed in claim 3, wherein the time delay unit is adapted to optionally adjust delay time by varying the values of the time delay resistor and/or capacity.

19. A gate pulse modulator as claimed in claim 11, wherein a time constant adjusting resistor is interconnected between the seventh resistor and the gate high signal terminal and a time constant adjusting capacitor is interconnected between the base terminal of the sixth transistor and the base voltage source, so that when the gate high voltage through the output terminal is lowered to the level of the driving voltage, the gate high voltage is exponentially reduced for a predetermined length of time.

* * * * *